United States Patent [19]

Jonason

[11] 4,024,619

[45] May 24, 1977

[54] METHOD OF MANUFACTURING A FLAT HEAT-EXCHANGER TUBE FROM THIN, FLEXIBLE METAL STRIP MATERIAL

[75] Inventor: Karl Gunnar Jonason, Vasteras, Sweden

[73] Assignee: Granges Essem Aktiebolag, Vasteras, Sweden

[22] Filed: Feb. 20, 1975

[21] Appl. No.: 551,412

[30] Foreign Application Priority Data

Feb. 21, 1974 Sweden ..... 7402317

[52] U.S. Cl. ..... 29/157.3 R; 228/144; 228/150; 228/173; 113/116 UT; 138/171

[51] Int. Cl.[2] ..... B23P 15/26; B21D 51/16; B21D 53/04

[58] Field of Search ..... 29/157.3 R, 157.3 A; 228/173, 144, 153, 149, 150, 151; 113/116 UT; 138/170, 171

[56] References Cited

UNITED STATES PATENTS

| | | | |
|---|---|---|---|
| 370,404 | 9/1887 | Norton | 138/171 |
| 837,976 | 12/1906 | Taylor | 113/116 UT |
| 1,332,932 | 3/1920 | Sussman | 228/144 |
| 2,170,639 | 8/1939 | Hopkins | 138/171 |
| 2,196,708 | 4/1940 | Reid | 228/173 |
| 2,218,127 | 10/1940 | Urschel | 228/144 |
| 2,401,542 | 6/1946 | Booth | 228/150 |
| 3,554,150 | 1/1971 | Goetschius | 228/149 |

*Primary Examiner*—C.W. Lanham
*Assistant Examiner*—Daniel C. Crane

[57] ABSTRACT

A method of manufacturing a flat heat-exchanger tube from thin, flexible metal strip material, comprising the steps of bending first and second longitudinal edge portions of the strip into an overlapping position over a central portion of said strip, bending the innermost edge portion in the vicinity of its edge at an angle to the remaining portion of said last mentioned edge portion to form a support flange and pressing said edge portions together under reaction from said central portion, via the support flange pressed thereagainst, while joining said longitudinal edge portion by means of soldering.

2 Claims, 2 Drawing Figures

Figure 1:
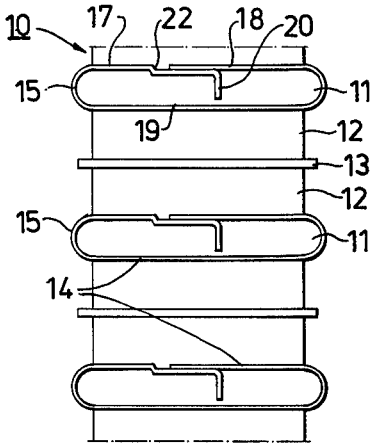

METHOD OF MANUFACTURING A FLAT HEAT-EXCHANGER TUBE FROM THIN, FLEXIBLE METAL STRIP MATERIAL

The present invention relates to a method of manufacturing a flat, heat-exchanger tube from thin, flexible metal strip material. It is previously known to manufacture flat heat-exchanger tubes from flexible metal strip material by bending the longitudinal edge portions of the strip towards each other and scarfing said edge portions together, whereafter the scarfed joint is sealingly fixed by soldering said joint to form a closed tube.

With this method, the joint is placed on one short side of the tube.

In the case of heat-exchanger tubes which are provided on the flat sides thereof with longitudinally extending surface-enlargening means, such as folded metal strip, it has been found, however, that the tube material is practically always subject to fatigue in the vicinity of the solder joint located on one short side of the tube. This is probably due to the fact that with such a solder joint, which practically covers the whole of one short side of the tube, only an extremely limited area remains within which movement of the tube material can be taken up when the tube is subjected to pulsating loads during the operation of the heat exchanger. This load is especially critical at the position of the joint, while, on the other hand, the opposing short side of the tube is only subjected to fracture in exceptional cases. This is thought to be due to the fact that this latter short side presents a considerably larger area for absorbing and distributing the stresses and strains occuring in the tube material. It has therefore been necessary to select a tube thickness such that the short side of the tube on which the solder joint is located is also able to withstand loads occurring during the operation of the heat exchanger.

Since, however, efforts are constantly made to obtain the highest degree of compactness and lightness with respect to heat-exchanger units, efforts have been made to free said short tube sides from the critical stress concentrations which occur at the solder joints on said short sides, by moving the solder joint from the short side to the long side of said tube.

Experiences obtained from the application of this modification of the working procedure have not been encouraging, however, especially in respect of flat heat-exchanger tubes on which surface-enlargening means shall be soldered to the flat long sides of the tubes. When soldering the surface-enlargening means over the solder joint of the tube it has been found extremely difficult to obtain an acceptable fixation between the flat side of the tube on which the solder joint is located and the surface-enlargening means. Because of this it has been found necessary to retain the solder joint on one of the short sides, despite the relatively large quantity of material which is wasted in this way, thereby to afford a good fixation between the tube and the suface-enlargening means.

The object of the present invention is to provide, whilst utilizing the tube material in an optimal manner, a heat-exchanger which has the least possible weight and which enables the surface-enlargening means to be firmly fixed to the tube and which is also reliable when said tubes are subjected to pulsating loads.

In accordance herewith the invention is mainly characterized in that first and second longitudinal edge portions of the strip are bent over a central portion thereof so that said edge portions overlap said central portion, whereafter the mutually overlapping first and second longitudinal edge portions are soldered to form a complete tubular profile, wherein the second longitudinal edge portion, which is to project over the first longitudinal edge portion, is bent in the vicinity of its edge at an angle to the remaining portion of said first longitudinal edge portion to form a support flange, and wherein soldering of the first and second longitudinal edge portions is effected whilst mutually pressing said edge portions together under reaction from the central portion, via the support flange pressed thereagainst.

The invention will now be described in more detail with reference to an embodiment thereof diagrammatically illustrated in the accompanying drawing, other features of the invention being disclosed in conjunction therewith.

Figure 2:
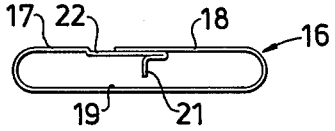

In the drawing FIG. 1 shows a section of a portion of a heat-exchanger comprising flat, heat-exchanger tubes manufactured in accordance with the invention, and FIG. 2 a section of a modified tube.

In the drawing reference numeral 10 indicates generally a heat-exchanger comprising a number of tubes 11 which have been produced in accordance with the invention and between which are arranged surface-enlargening means 12, and further comprising bands 13 arranged between said surface-enlargening means 12. The heat-exchanger 10 can be manufactured in different ways, but in accordance with a preferred method, the tubes 11 are manufactured individually in one manufacturing process and the surface-enlargening means 12 in another manufacturing process. Prior to arranging the surface-enlargening means 12 on the tubes 11, said means 12, which may have the form of folded metal strip, are provided pairwise with an intermediate band 13. In this way handling of the different units is simplified for the final assembly of the heat-exchanger. To enable the tubes 11 to be dimensioned in a manner such that all the material of a tube 11 is utilized as effectively as possible, so that the prevailing loads on the heat-exchanger can be taken up, the tubes 11 are provided with a longitudinally extending joint on one long side 14 of the tubes 11. This means that the end wall portions 15 of the flat tubes are able to take up the movement caused by the alternating loads to which the heat-exchanger is subjected as a result of a pulsating pressure of the medium flowing in the tubes 11.

When manufacturing a heat-exchanger tube 11 or 16 shown in FIG. 1 and FIG. 2, respectively, there is used a thin, flexible metal strip the side edge portions 17 and 18 of which are bent over a central portion 19 so as to overlap the central portion 19 of the tube. The overlapping edge portions 17 and 18 are soldered together in this position to provide a closed tubular profile.

Since, in accordance with the invention, it is intended to reduce the weight of the heat-exchanger tubes to the greatest possible extent, there is preferably selected a strip material of extremely thin thickness, which means, however, that the two side edge portions, which in accordance with the invention are to be soldered together in their overlapping position, are too weak to be positioned in the correct position of engagement with each other during the welding process, which in reality would result in an incomplete and unreliable joint if no additional measures were taken.

This problem is solved by means of the invention in that the one longitudinal edge portion which is to be overlapped by the other longitudinal edge portion is bent adjacent its edge surface at an angle to the remaining portion of said longitudinal edge portion to form a support flange 20 (FIG. 1) and 21 respectively (FIG. 2). Preferably, respective support flanges are bent substantially at right angles to their side edge portions, as shown in FIGS. 1 and 2. A variation is shown in FIG. 2 in which the support flange 21 is placed centrally beneath the joint, which improves the supporting effect of said flange.

By providing an extremely good supporting effect, the width of the soldered joint can be considerably reduced, i.e. a reduction in the extent to which the side edge portions must overlap, thereby simultaneously reducing the quantity of material used. When the tube is to be provided with surface-enlargening means, the soldered joint need not be dimensioned to enable said joint to absorb occurring tensile stresses itself, since these stresses are also taken up by the surface-enlargening means.

When suitable, one of the longitudinal side portions, such as side portion 17 as shown in FIGS. 1 and 2, may also be provided with a depressed portion 22 for receiving the other side edge portion 18, the same side of said tube being in this way flatter than if the two said edge portions were caused to directly overlap each other without such a depressed region being provided.

The side edge portions 17 and 18 are finally soldered together whilst pressing said side edge portions together under reaction from the central portion via the support flange 20 or 21, which is thereby pressed against said central portion. The support flange is not normally soldered to said portion, although this may be desirable in certain cases and lies within the scope of the invention.

By means of the aforedescribed method, the weight of a heat-exchanger tube can be reduced whilst providing a favourable reaction support surface for the soldering operation and whilst releaving the short sides of the tube from critical fatigue defects occurring when the solder joint is placed on one short side in accordance with the earlier technique.

The invention is not restricted to the illustrated and described embodiment thereof, but can be modified within the scope of the following claims.

I claim:

1. A method of making a flat heat-exchanger tube from a thin, flexible metal strip material having first and second longitudinal end edge portions, comprising the steps of bending a marginal portion of the first one of the longitudinal end edge portions of said strip to from a substantially right angle support flange to the remaining portion of said longitudinal edge portion, bending the remainder of said first longitudinal end portion of said strip into a position over and spaced apart from a central portion of said strip, bending the second one of said longitudinal end edge portions into an overlapping position in relation to said first longitudinal end edge portion, and soldering said overlapping end edge portions together to form a flat tubular profile, while said right angle support flange presses against said central portion during such soldering and to prevent collapse of the thin-walled tube when compressing forces are applied onto the flat surfaces of said complete tube.

2. A method as in claim 8, wherein a length of said first longitudinal end edge portion is bent to form an angle therewith, bending back the remaining portion of such last-mentioned length into its original direction to accommodate the thickness of the second end edge portion in overlapping and abutting engagement thereagainst.

* * * * *